United States Patent [19]

Bogner

[11] 4,021,815

[45] May 3, 1977

[54] CIRCULARLY POLARIZED TRANSMITTING ANTENNA EMPLOYING END-FIRE ELEMENTS

[76] Inventor: Richard D. Bogner, 4 Hunters Lane, Roslyn, N.Y. 11576

[22] Filed: Mar. 22, 1976

[21] Appl. No.: 669,311

[52] U.S. Cl. ..... 343/727; 343/770; 343/836; 343/891

[51] Int. Cl.[2] ..... H01Q 21/24

[58] Field of Search ..... 343/727, 770, 833, 836, 343/890, 891

[56] References Cited

UNITED STATES PATENTS 3,821,745 6/1974 Bogner ..... 343/891

*Primary Examiner*—Eli Lieberman

*Attorney, Agent, or Firm*—Bauer, Amer & King

[57] ABSTRACT

An omnidirectional circularly polarized transmitting antenna employing a single row of slot antennas mounted on a metal support tube and a single row of dipole antennas mounted between the slots and a narrow vertical metal member parallel to the dipoles, the slot and dipole antennas each excite parasitic end-fire directors to control radiation patterns and phase centers.

4 Claims, 5 Drawing Figures

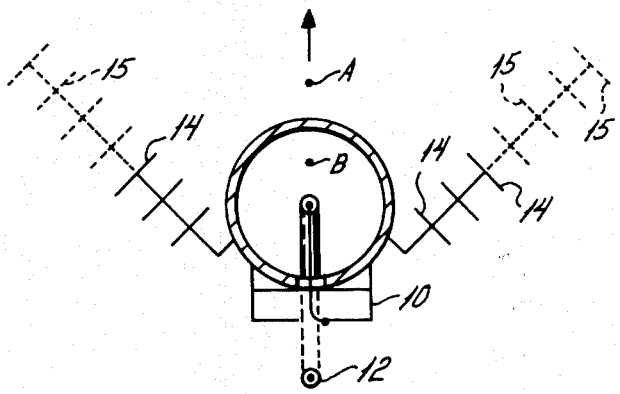
FIG. 1A (PRIOR ART)
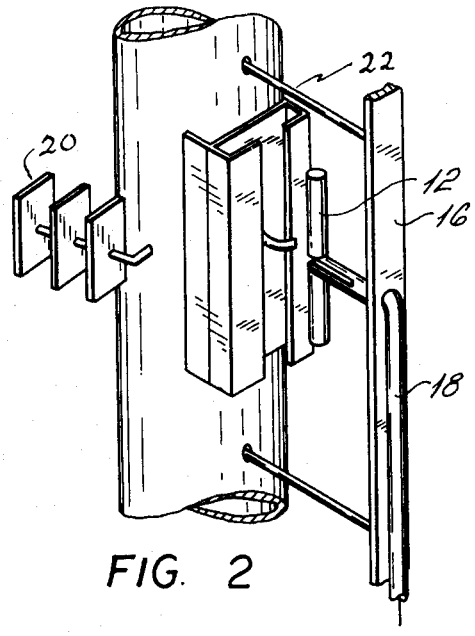
FIG. 2
FIG. 1B (PRIOR ART)
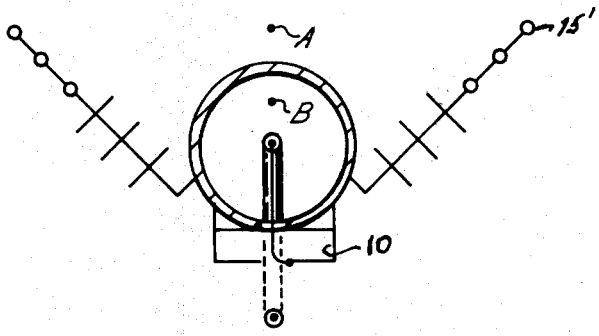
FIG. 4
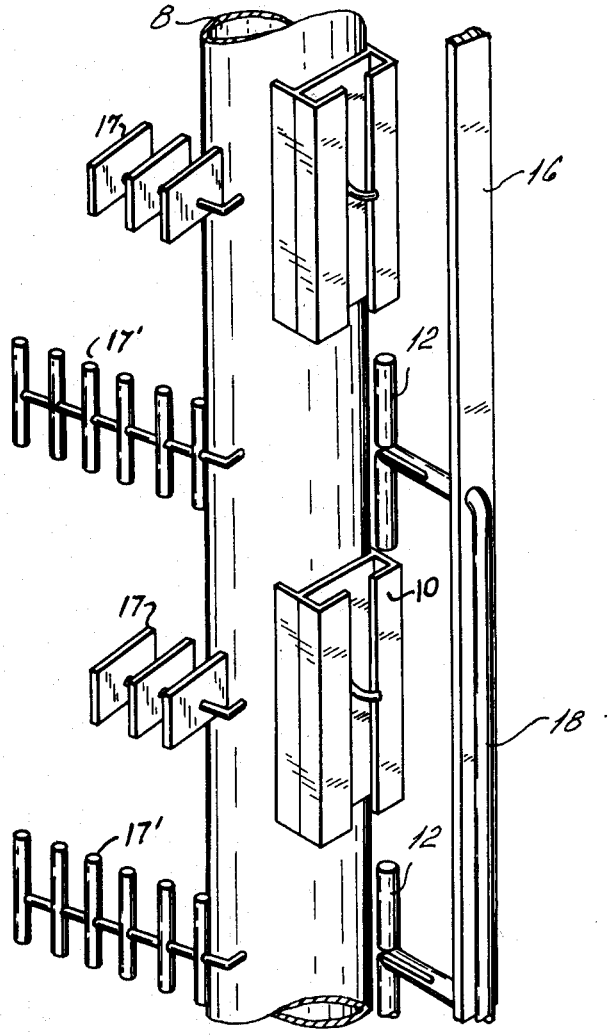
FIG. 3
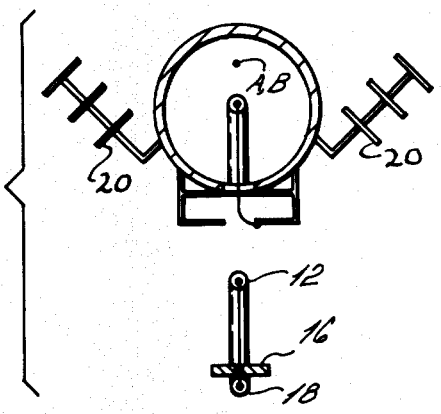

CIRCULARLY POLARIZED TRANSMITTING ANTENNA EMPLOYING END-FIRE ELEMENTS

BACKGROUND OF THE INVENTION

This invention relates to transmitting antennas employing end-fire parasitic elements and, in particular, to circularly polarized antennas.

A problem encountered in UHF-TV broadcasting antenna design is the achievement of high gain with an omnidirectional pattern in the azimuth plane at minimum cost (omnidirectional patterns in the azimuth plane are most commonly employed at this time). Prior approaches have included, for example, the use of inherently nondirective horizontally polarized elementary antennas such as slots, loops or V's mounted or arranged on towers to form vertical linear arrays. These array component antenna elements are interconnected by transmission lines of series, parallel or combined types, such that each is fed a portion of the transmitter power. In order to achieve high overall gain, a vertical array of many such elementary antennas must be long, e.g. in the order of 20 feet to 50 feet or more, for the frequencies used in UHF-TV broadcasting (470 mHz. to 890 mHz.). Therefore, the supporting pole or tower must be of substantially large diameter in terms of wavelength in order to physically support the antenna and maintain stability in wind; in this case "substantially large" is intended to encompass those towers having a major transverse dimension above $\lambda/4$ and in practice often greater than $\lambda$. A simple single vertical linear array of loops or the like, supported by a tower of openwork structural members or of solid cylindrical form, such as a pipe, of this order of magnitude in size, will not provide an omnidirectional pattern, but will typically exhibit a substantially larger deviation than 4 db. from omnidirectional. (A total signal strength variation as a function of azimuth plane direction of up to around 4 db. generally is accepted to be omnidirectional.) Therefore, it is a practice, particularly in UHF-TV broadcasting, to employ a considerably more elaborate and expensive installation than a single vertical linear array of simple antennas. Often such installations employ, e.g. dipole or zigzag panels on each of three or four sides of a tower, or, alternatively, staggered arrays of many slots cut into heavy wall cylinders or long helices wrapped around such cylinders.

There will be disclosed hereinafter a very simple and inexpensive means of achieving an omnidirectional pattern, employing a single vertical linear array of elementary antennas such as slots, loops or V's, even when these are mounted on a large cylinder (e.g. 10 inch diamter round pipe or 18 inch side triangular framework tower at UHF-TV frequencies) which would normally cause pattern departure from omnidirectional by more than e.g., 8 db. due to shadowing by the tower. It has been found that by locating one or more suitable end-fire directors, such as the discrete metallic member or plate-on-rod types, on portions of the outside of the pole or tower, and in or near the plane of each elementary antenna, but not mounted in the conventional manner, i.e. not on the axis of the antenna beam, the plate-on-rod directors act as parasitic elements, but in a different way. The pattern can by this means be varied and, for example, be made omnidirectional, if these parasitic elements are so adjusted as to fill in the tower shadow.

It is well known that a feature of disc-rod antennas such as are disclosed, for example, in U.S. Pat. Nos. 2,955,287 and 3,015,821, is that, if conventionally constructed and excited symmetrically about the "launcher" antenna, they form narrow beam patterns with high gain directed in one direction along the director axis. Accordingly, a rather surprising aspect of the present invention is that these highly directional elements can provide a circularly polarized omnidirectional pattern.

Of considerable additional value is the further finding that specially shaped directional azimuth plane radiation patterns (i.e. patterns not omnidirectional but departing slightly or even considerably from omnidirectional) can very easily be obtained by the same general means. This may be used, for example, to provide optimization of coverage for a particular terrain or site. These results are obtained by varying the number, design, or pointing, or combinations, of the parasitic end-fire directors used in conjunction with each elementary antenna on a pole or tower. In the same manner in which the energy can be directed around the tower to fill nulls behind it to form omnidirectional patterns, the energy can be so directed to provide lobes, or even deep nulls, in certain azimuth directions. Sometimes more than one elementary fed antenna may be used at one level or bay on a pole or tower (each radiator level being called a "bay"), with the relative phase and amplitude adjusted, along with parasitic element adjustment, to achieve the desired or required patterns.

Since TV broadcasting in the United States has until now employed horizontal polarization, the antennas so far primarily considered have had this polarization, with the elementary antennas described being inherently nondirective in their E planes, which is made the azimuth plane. It has been found, in addition, however, that if elementary antennas inherently nondirective in their H planes are used, and they are arranged to provide polarization parallel to the pole or tower (i.e. vertical polarization), similar pattern control through the use of parasitic directors can be obtained in this polarization. Such elementary antennas include the dipole. Further, horizontally and vertically polarized elementary antennas may be used simultaneously with proper relative interconnection to achieve other composite polarizations including circular, both polarizations using common parasitic end-fire directors for pattern control. It is anticipated that TV broadcasters in the United States may, as has been the case for FM radio, be authorized by the F.C.C. to also radiate a vertical polarization component, or circular polarization. While antennas of the prior art generally cannot do this, the entennas described herein can be designed to do it initially, or as a simple future addition.

It has been found that, when using the teaching of my prior U.S. Pat. No. 3,587,108 and, in particular FIG. 5 thereof, to obtain a bipolarized antenna, as described therein in column 7, lines 48 to 70, phase center coincidence between the vertical and horizontal polarization components cannot be obtained for omnidirectional radiation patterns. In addition, it is difficult in practice to feed a series of dipoles located forward of slots because the feed lines to the dipoles going back to the support pipe tend to disturb the radiation from the slot, and a large number of such lines are complicated to interconnect in the support tube.

It is, however, very desirable to utilize the combination of dipole and slot, for each has the required radiation characteristic in each plane and, therefore, results in the same number, and the minimum required number, of vertically stacked elements for a given gain.

BRIEF SUMMARY OF THE INVENTION

I have found that the above-stated problems can be solved by placing a long, narrow metallic member parallel to the conductive support cylinder and such that the dipole is located between it and the cylinder. This member serves both to support or contain the coaxial feed lines for the dipoles, allowing e.g.., series feeding of a group of conventional transverse fed dipoles arranged in a linear end-on array, and to allow creation of a vertically polarized omnidirectional radiation pattern. With this member, the same plate-rod directors form an omnidirectional pattern for both vertical and horizontal components, and, in addition, provide phase center coincidence between vertical and horizontal components and; therefore, very close to circular (and not elliptical or 45° linear) polarization in every azimuth. This metallic member must be less than $\lambda/4$ in cross-section (transverse to the support tube axis), over $\lambda/2$ in dimension in the direction parallel to the tube axis and spaced between $\lambda/8$ and $\lambda/2$ from the dipole. The metallic member may even be many wavelengths long in the vertical direction, enclosing or supporting the coaxial feed system for many dipoles, and even also supporting the dipoles. (The dipole axis should be between $\lambda 12$ and $\lambda/2$ from the slot face.)

In certain cases it is not practical to design the director structures to simultaneously provide the best omnidirectional pattern for both the horizontal polarization (fed by the slot) and the vertical polarization (fed by the dipole), and also to have substantially coincident phase centers. This is especially true where the support tube is large (over 38 $\lambda$ diameter). In such case it may be desirable to alternate the design by vertically staggering by about $\lambda/2$, the approximately $\lambda$ spaced slot array and the approximate $\lambda$ spaced dipole array, so that instead of the slot vertical center and the dipole vertical center being at the same point on the vertical support structure, as previously, and therefore using the same director structure, the slots and dipoles can now use separate director structures, spaced alternately at $\lambda/2$ intervals vertically. In this manner the plate director structures can be separately optimized for each polarization omnidirectional patterns and for phase center coincidence.

This combination of end-fire directors and elementary antennas provides a broad bandwidth and low Q which renders the antenna insensitive to environmental changes caused by dirt, ice, snow, etc.

It is a general object of this invention to provide an improved transmitting antenna exhibiting a high azimuth plane gain.

A further object is to provide a low cost, fully omnidirectional antenna eliminating, in a simple manner, nulls caused by the "tower shadow".

Another object is to provide a low cost, high gain antenna which can easily give a shaped azimuth radiation pattern.

Still another object is to provide a simple antenna which exhibits high gain and directivity over a large frequency band.

A further object is to provide a high gain antenna which can transmit circularly polarized signals omnidirectionally.

Another object is to provide a low cost antenna which exhibits high gain and directivity for any polarization, including simultaneous vertical and horizontal and circular.

Still a further object is to provide an antenna with a simple means of adjusting relative lobe and null angles to achieve a desired radiation pattern.

Another object of this invention is to provide a horizontally polarized slot antenna which may be field modified to circular polarization.

These and other objects, features and advantages of the invention will, in part, become obvious from the following more detailed description of the invention, taken in conjunction with the accompanying drawings which form an integral part thereof..

IN THE DRAWING

FIG. 1A & 1B are schematic plan views of prior art slot-dipole antennas;

FIG. 2 is a pictorial representation of a slot-dipole circularly polarized antenna of this invention;

FIG. 3 is a top-plan view of the slot-dipole antenna of FIG. 2; and

FIG. 4 is a pictorial representation of an alternative embodiment of the circularly polarized antenna of this invention.

DESCRIPTION OF THE PREFERRED EMBODIMENT(S):

In the figures, FIG. 1A shows a prior art design with a horizontally polarized slot 10 and a vertically polarized dipole 12 on a supporting metal cylinder. Typically, three director plates 14 on each side are proper to create an omnidirectional horizontal pattern for H polarization, with the resulting phase center at point B. The pattern for the vertical polarization using these three plates is not omnidirectional but has too low gain in the rear direction, requiring the additional plates 15 for example, four plates on each side (shown dotted) to obtain an omnidirectional pattern, with phase center at point A. (The horizontal pattern with these additional plates is now no longer omnidirectional, but too strong toward the rear.). Therefore, this version is neither omnidirectional for both vertical and horizontal polarization simultaneously, nor do the phase centers generally coincide.

FIG. 1B is a prior art antenna like that of FIG. 1A except that the last four directors 15' are modified such that they are not visible to the horizontally polarized slot. This is achieved by reducing the dimension of the plane of the electric vector of the slot below the ¼ wavelength to ½ wavelength range required, for example, by employing elongated rods as shown. Thus, one of the limitations of the device of FIG. 2 is overcome in the embodiment of FIG. 1B wherein the radiation patterns for vertical polarization and horizontal polarization are both omnidirectional within accepted tolerance, e.g. ± 1 ½ db. However, the phase center situation is unchanged from that shown in FIG. 1A, namely, the failure to produce circular polarization in every azimuth no matter what relative phase is chosen between vertical and horizontal polarized feed lines.

FIG. 2 shows the design modified to that of the present invention by the addition of a vertical metal member 16 on the forward side of the dipole 12, which also serves to support the dipole and the feed lines 18 for the dipole in the example shown. It has been found that in this case the e.g. three plates 20 on each side of the driven slot 10 and dipole 12 antennas as shown, can be made to create omnidirectional patterns for both vertical and horizontal polarizations, and, also, the phase centers now coincide, so that circular polarization in every azimuth (within the accepted definition of 3 db.) can be obtained by proper relative excitation phase. It should be noted that with regard to plates 20, both vertical and horizontal dimensions must be at least $\lambda/4$ and no more than $\lambda/2$, since both dimensions are parallel to the electric field vector of one of the two orthogonal driven elements. The vertical metal member 16 should have a horizontal cross-section dimension in the range $\lambda/8$ to $\lambda/4$. As shown in the top view of FIG. 3, the phase centers A,B coincide.

The vertical metal member 16 is supported from the support pipe 8 by horizontal members 22 which may be a dielectric material or metal if located at null points between bays. The bays are normally one wavelength apart.

In FIG. 4 there is shown an alternative embodiment wherein support pipe 8 carries a plurality of bays of slot antennas 10 and dipoles 12 backed by metal member 16 which carries feed lines 18. The dipoles are offset from the slot antennas by a distance $\lambda/2$ along the support tube so that different directors and numbers of same can be employed to serve the vertical and horizontal polarizations. In this way fine control of pattern and phase center location can be obtained for optimum performance. The slot antennas 10 are provided with directors 17 and the dipoles are provided with directors 17'. The directors are shaped to provide a dimension of between $\lambda/4$ to $\lambda/2$ in the plane of polarization.

The slot antennas and dipole antennas are shown fed by conventional coaxial lines. Methods of exciting slots and dipoles are well known in the art and, accordingly, have not been discussed in detail.

While there have been shown and described and pointed out the fundamental novel features of the invention as applied to a preferred embodiment(s) thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. An antenna assembly for transmitting signals of wavelength, $\lambda$, comprising an elongated electrically conductive supporting structure, at least one bay including at least two driven antennas of orthogonal polarizations carried by said support structure and defining a common radiation axis extending therefrom, means for feeding electrical energy to said driven antennas, and at least one end-fire parasitic director having a longitudinal axis and comprising at least one discrete conductive member disposed along said longitudinal axis, said discrete member having a major dimension in the planes of electric field vector of transmitted signals of wavelength $\lambda$ of at least $\lambda/4$ and no more than $\lambda/2$ said end-fire director being so positioned relative to said driven antennas and support structure as to alter the shape of the radiation patterns of said driven antenna and support structure, and a metal member parallel to the elongated support structure axis of a dimension in a plane transverse to said axis of less than $\lambda/4$ and greater than $\lambda/2$ long in direction parallel to the axis, intersecting the radiation axis of the driven antennas and so located that both driven antennas are between said metal member and the said supporting structure.

2. The antenna assembly of claim 1 wherein one driven antenna is a slot polarized transverse to the longitudinal axis, of said supporting structure and the other is a dipole polarized parallel to the support axis and to the metal member and $\lambda/12$ to $\lambda/2$ from the slot antenna and the distance from said metal member to said dipole is between $\lambda/8$ and $\lambda/2$.

3. The antenna assembly of claim 1 wherein the said two driven antennas are spaced $\lambda/4$ apart and parasitic directors associated with each of said driven antennas.

4. The antenna assembly of claim 2 wherein said dipole is fed by a means carried by said metal member.

* * * * *